US011885112B2

(12) United States Patent
Punnett

(10) Patent No.: US 11,885,112 B2
(45) Date of Patent: Jan. 30, 2024

(54) TOILET INFECTIOUS AIRBORNE PARTICULATE FILTRATION AND DISINFECTION SYSTEMS

(71) Applicant: Clayton Punnett, Neptune Beach, FL (US)

(72) Inventor: Clayton Punnett, Neptune Beach, FL (US)

( * ) Notice: Subject to any disclaimer, the term of this patent is extended or adjusted under 35 U.S.C. 154(b) by 0 days.

(21) Appl. No.: 18/134,590

(22) Filed: Apr. 14, 2023

(65) Prior Publication Data

US 2023/0383513 A1 Nov. 30, 2023

Related U.S. Application Data

(60) Provisional application No. 63/473,446, filed on May 31, 2022.

(51) Int. Cl.
*E03D 9/05* (2006.01)
*E03D 9/00* (2006.01)

(52) U.S. Cl.
CPC ..... *E03D 9/05* (2013.01); *E03D 9/005* (2013.01)

(58) Field of Classification Search
CPC ..... A47K 13/30; A47K 13/307
See application file for complete search history.

(56) References Cited

U.S. PATENT DOCUMENTS 4,301,555 A * 11/1981 Poister ..... E03D 9/052 4/213
8,603,257 B2 * 12/2013 Burt ..... E03D 9/032 4/231
10,724,219 B2 * 7/2020 Huitron ..... E03D 9/005
2020/0245828 A1 * 8/2020 Bahn ..... F16J 15/027

FOREIGN PATENT DOCUMENTS

WO WO2018091858 * 5/2018 ..... E03D 9/052

* cited by examiner

*Primary Examiner* — David P Angwin
*Assistant Examiner* — Nicholas A Ros

(57) ABSTRACT

A toilet infectious airborne particulate filtration and disinfection system is provided. The system includes a modified toilet seat assembly, with circumferentially arranged grooves on an underside of the modified toilet seat assembly. The system also includes a seat air filtration unit configured to mate with the grooves. The system further includes a modified toilet lid assembly, with grooves on an underside of the lid. The system includes a lid air filtration unit configured to mate with the grooves. The system also includes an internally arranged disinfectant dispersing mechanism, with a disinfectant fluid reservoir, positioned internally to a toilet bowl enclosure. The system also includes a plurality of spray nozzles positionable about the toilet bowl enclosure and a plurality of disinfectant fluid delivery tubes positioned internally to the toilet bowl. The system includes a disinfectant propellant mechanism and activation control device. System is adaptable to a urinal.

10 Claims, 10 Drawing Sheets

TOILET INFECTIOUS AIRBORNE PARTICULATE FILTRATION AND DISINFECTION SYSTEMS

CROSS-REFERENCE TO RELATED APPLICATIONS

This application claims priority to provisional application 63/473,446 filed on May 31, 2022, and is incorporated herein by reference in its entirety. Also, this application claims priority to utility application Ser. No. 17/809,635 filed Jun. 29, 2022, and is incorporated herein by reference in its entirety. Further, this application claims priority to utility application Ser. No. 17/810,412 filed on Jul. 1, 2022, and is incorporated herein by reference in its entirety.

FIELD OF THE INVENTION

The present invention relates generally to airborne filtration systems, and more particularly, to toilet infectious airborne particulate filtration and disinfection systems, which includes a plurality of filters and a plurality of disinfectant dispersing mechanisms to provide personnel protection against infectious airborne particulate in areas of the vicinity of toilets.

BACKGROUND OF THE INVENTION

Many methods, devices, and systems have been unsuccessfully attempted to choose a combination of systems to provide protection against infectious airborne particulate matter. Many of these previous attempts were costly and cumbersome to use and quite often did not take into consideration all of the pathways that particulate could enter into the immediate breathing zones of personnel around toilets.

Quite often previous attempts of providing protection systems included dispersing disinfection aerosols into the breathing zones of personnel around a toilet. These manual processes are time consuming, are vulnerable to not being deployed quickly enough to mitigate the harm of infectious airborne particulate, and ultimately more expensive due to the numerous amounts of manually deployed aerosols needed.

Further, previous methods did not address filtration of airborne particulate at the toilet enclosure, and only contemplated circulating air through discrete filtration units outside of the toilet enclosure. Consideration for a totality of conditions, such as degree of hazard of the infectious particulate, dwell time of the particulate in the breathing zones exterior to the toilet, and overall efficiency in removing the infectious airborne particulate from the areas exterior to the toilet were not taken into account in the design of toilet filtration and disinfection protection systems.

Additionally, these previous methods and systems were costly, cumbersome due to the manual nature involved in the design process, and time consuming to install, operate, and maintain.

Accordingly, there is an established need for toilet infectious airborne particulate filtration and disinfection systems which solve at least one of the aforementioned problems. Further, there is an established need for toilet infectious airborne particulate filtration and disinfection systems which can be utilized more efficiently and effectively and provide an effective and efficient filtration and disinfection of infectious airborne particulate, while meeting functional demands, and without excessive costs.

SUMMARY OF THE INVENTION

The present invention is directed to innovative and cost-effective toilet infectious airborne particulate filtration and disinfection systems which can be utilized with a variety and plurality of toilet bowl and toilet lid configurations. Further, the present invention is directed to innovative, ergonomically designed, toilet infectious airborne particulate filtration and disinfection systems utilizing custom and modular made toilet seats and lids to include custom and modular made channels, custom and modular made filters, and disinfecting aerosol dispensers positionable within the toilet enclosure to efficiently and effectively reduce airborne particulates and disinfect surfaces of the interior of the toilet enclosure.

In an aspect, a toilet infectious airborne particulate filtration and disinfection system is presented. The system includes a modified toilet seat assembly, wherein the modified toilet seat assembly also includes rear attachment devices configured to attach the modified toilet seat assembly to a standard toilet bowl. The system further includes circumferentially arranged grooves on an underside of the modified toilet seat assembly. The system includes a seat air filtration unit configured to mate with the circumferentially arranged grooves on the underside of the modified toilet seat assembly and arranged to form an airtight seal between a top surface of a toilet bowl rim and the underside of the modified toilet seat assembly when the modified seat assembly is positioned in a down position, and the modified seat assembly and the seat air filtration unit is resting upon the top surface of the toilet bowl rim.

The system also includes a modified toilet lid assembly, wherein the modified toilet lid assembly also includes rear attachment devices configured to attach the modified toilet lid assembly to the modified toilet seat assembly. The system further includes circumferentially arranged grooves on an underside of the modified toilet lid assembly. The system includes a lid air filtration unit configured to mate with the circumferentially arranged grooves on the underside of the modified toilet lid assembly and arranged to form an air tight seal between a top surface of the modified toilet seat assembly and the underside of the modified toilet lid assembly when the modified lid assembly is positioned in a down position, and the modified lid assembly and the lid air filtration unit is resting upon the top surface of the modified toilet seat assembly.

The system includes an internally arranged disinfectant dispersing mechanism, wherein the disinfectant dispersing mechanism further includes a disinfectant fluid reservoir, positioned internally to a toilet bowl enclosure. The system also includes a plurality of spray nozzles positionable about the toilet bowl enclosure. The system further includes a plurality of disinfectant fluid delivery tubes positioned internally to the toilet bowl enclosure connecting the disinfectant fluid reservoir to the plurality of spray nozzles. The system includes a disinfectant propellant mechanism configured to provide a moving force to disperse disinfectant fluid through the plurality of spray nozzles. The system also includes a disinfectant spray activation control device to control spraying of disinfectant within the toilet bowl enclosure utilizing the internally arranged disinfectant dispersing mechanism.

In another aspect, A urinal infectious airborne particulate filtration and disinfection system is presented. The system includes a urinal lid assembly. The system also includes a urinal filter interface configured to interface with surface areas of a standard urinal and designed to create an airtight seal with the surface areas of the urinal on one side of the urinal filter interface and an airtight seal between mating surface areas of the urinal lid assembly and another side of the urinal filter interface and structured for the urinal lid assembly and the urinal filter interface to function in concert when the urinal filter interface and the urinal lid assembly are placed onto the standard urinal and wherein horizontal areas of the standard urinal support the urinal lid assembly and the urinal lid assembly and maintain an airtight seal around the standard urinal when placed on the standard urinal.

In embodiments, the system can include uniquely configured toilet seats with circumferentially oriented grooves located on an underside of the seat wherein the grooves are configured to house circumferentially oriented filters. The filters are configured to provide airtight seals between toilet bowl rim surfaces, toilet seat surfaces, and toilet lid surfaces.

In embodiments, the system can include applications for use with men's urinals. The system can take into account the unique geometries of the urinals and provide for both filtration and disinfection capabilities.

In embodiments, the system can include filters for both the spaces between the lid and the seat and between the seat and the top surface of the toilet bowl.

In embodiments, the system can take into account unique positioning of toilet seat bumpers and/or feet on an underside of the seat.

In embodiments, the system can take into account unique positioning of toilet lid bumpers and/or feet on an underside of the lid.

In embodiments, the system can include High Efficiency Particulate Air (HEPA) filtration capabilities.

In embodiments, the system can include cushioning materials on top and bottom sides of the filter units.

In embodiments, the Toilet Lid and Seat Filters are two filters that attach/adhere to the toilet lid and seat respectively. One attaches to the underside of the lid and is about the width of the seat, while the seat filter attaches under the seat and is about the width of the seat. The lid filter creates a seal on both the underside of the lid and the top of the seat, while the seat filter creates a seal between the underside of the seat and the top of the bowl. The filters will let air out and in while the toilet flushes, when air is expelled by the flush it is filtered. This expelled air is clean air from the flush and contains all the contaminants within the toilet.

In embodiments, the system can include variable compression values of the air filter such that in areas of filtration where the filter can interact with the bumpers and/or feet of the seat or lid, and can compress locally without affecting the filtration of the filter in areas where the bumpers and/or feet are not present.

In embodiments, the system can include adhesive components to maintain the filter units in place during operation.

In embodiments, the disinfectant systems can include automatic dispersing of disinfectant to allow covering toilet interior surface areas.

In embodiments, the system can include differential pressure sensors and annunciators which can indicate when the filter needs to be changed out due to filter loading.

In embodiments, the system can include filters with activated charcoal.

In embodiments, the system can include air freshener and aromatics which can be dispersed from the filter media during filtration so that air quality on the downstream side of filtration can have the fresheners and/or aromatics in the air.

These and other objects, features, and advantages of the present invention will become more apparent from the attached drawings and the detailed description of the preferred embodiments, which follow. It is understood that the drawings are designed for the purposes of illustration and not as a definition of the limits of the embodiments of the present invention. It should be further understood that the drawings are not necessarily drawn to scale and are merely intended to conceptually illustrate the methods and systems described herein.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

DETAILED DESCRIPTION

The following detailed description is exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
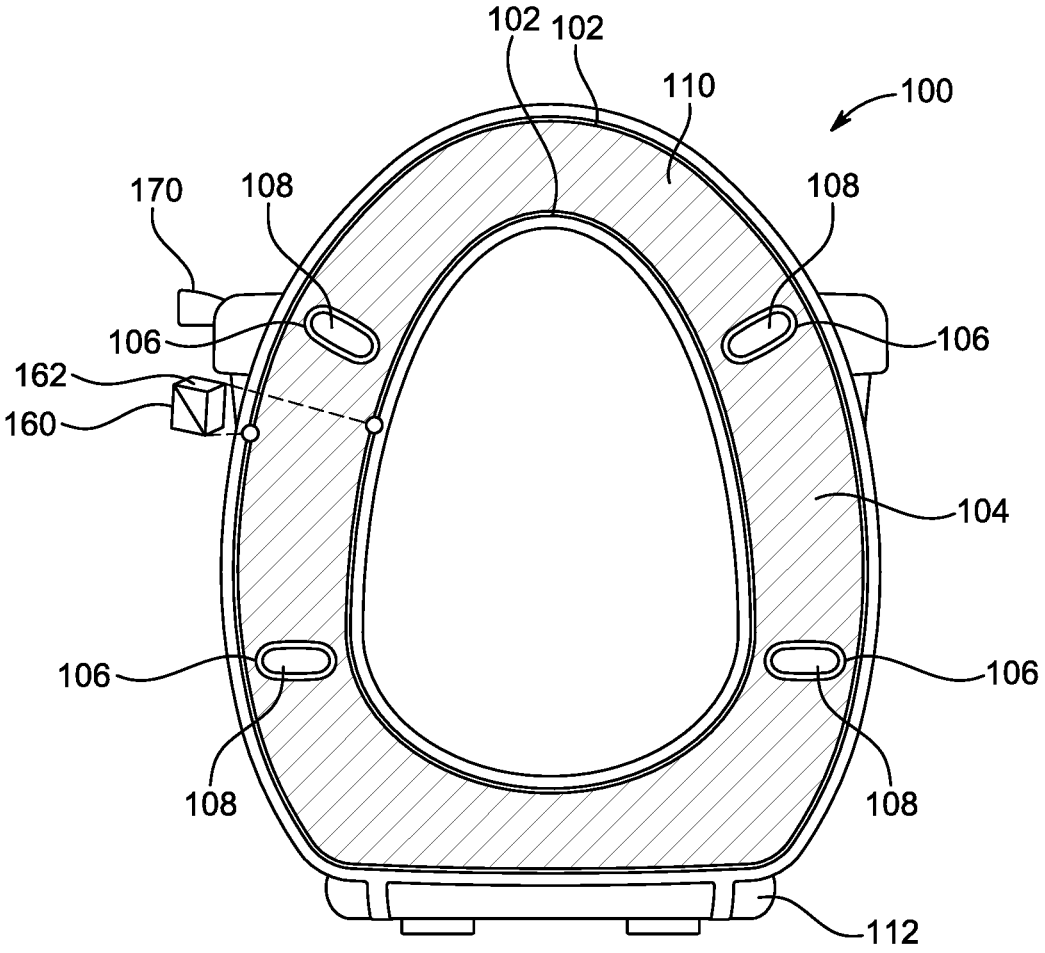
FIG. 1 presents a bottom view of a modified toilet seat assembly of an embodiment of the system.

Referring initially to FIG. 1, a bottom view of a modified toilet seat assembly 100 is displayed. The seat assembly 100 can include configured seat grooves 102 on an underside 104 of the seat assembly 100. The seat grooves 102 can be configured in a circumferential fashion about a surface area of the underside 104 of the seat assembly 100. The seat grooves 102 can include cutouts 106 around seat assembly 100 feet 108 or bumpers 108. The seat grooves 102 can also include two and/or two-dimensional characteristics configured to allow a seat air filtration unit 110 to be securely positioned onto the underside surface 104 of the seat assembly 100. Also, seat assembly 100 rear attachment device 112 can be configurable to allow a plurality of thicknesses of the seat air filtration unit 110 to be utilized in a plurality of toilet infectious airborne particulate filtration and disinfection system designs. In embodiments not shown, the seat assembly 100 can include one, two, three, four or more feet 108 or bumpers 108.

Further, the system can include differential pressure sensors 160 configured to monitor differential pressure across filter media. The system can include a plurality of sensors 160 monitoring a plurality of filters 110 and 124 and other filter media as deemed necessary in the system. Also, the system can include system annunciators 162 configured to alert system users of system conditions such as, but not limited to, filter media loading, wet filters, torn filters, disengagement of filter media, and/or the need to replace filters 110 or 124. In addition, the system can include system activation control device 170 configured to control and/or activate evolutions such as, but not limited to, disinfectant spray initiation, system flush, disinfectant refill procedure, freshener deployment within filter media, and/or cleaning cycles. Further, the control device 170 can be interconnected with a toilet flushing system so as to act in concert with toilet flushing evolutions, and it can be a stand alone control mechanism, such as a button, to actuate disinfectant dispersing through spray nozzles 138.

Figure 2:
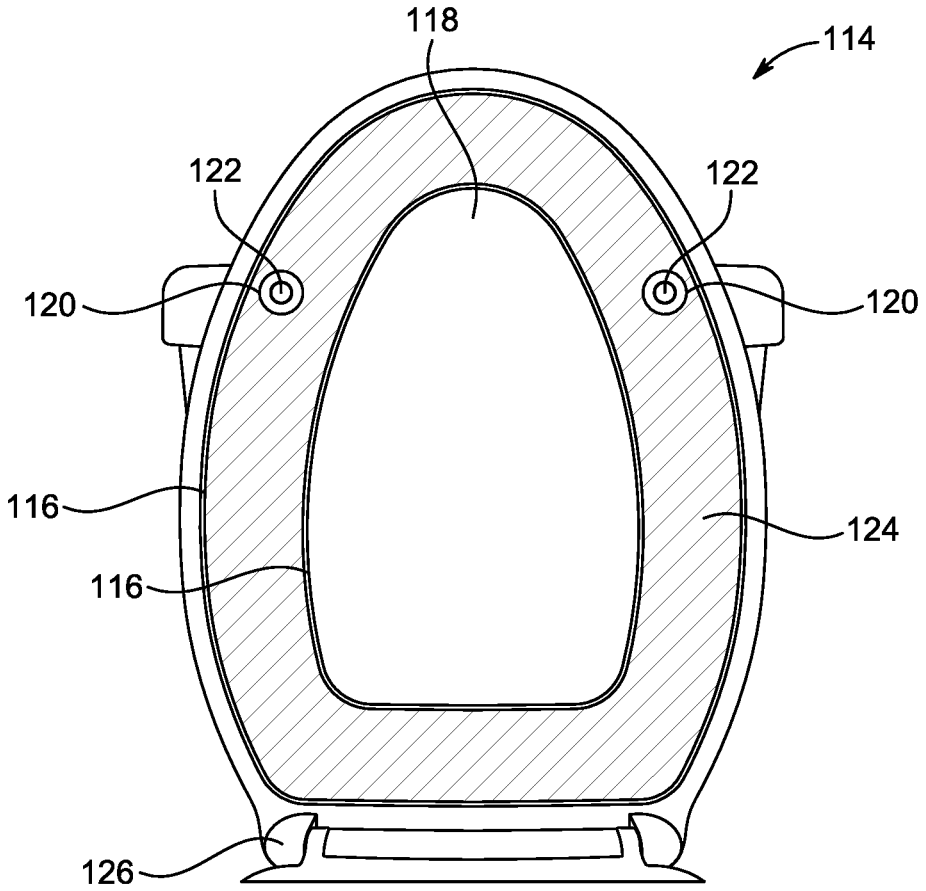
FIG. 2 presents a bottom view of a modified toilet lid assembly of an embodiment of the system.

Turning to FIG. 2, a bottom view of a modified toilet lid assembly 114 is displayed. The lid assembly 114 can include configured lid grooves 116 on an underside 118 of the lid assembly 114. The lid grooves 116 can be configured in a circumferential fashion about a surface area of the underside 118 of the lid assembly 114. The lid grooves 116 can include lid cutouts 120 around lid assembly 114 feet 122 or bumpers 122. The lid grooves 116 can also include two and/or two-dimensional characteristics configured to allow a lid air filtration unit 124 to be securely positioned onto the underside surface 118 of the lid assembly 114. Also, lid assembly 114 rear attachment device 126 can be configurable to allow a plurality of thicknesses of the lid air filtration unit 124 to be utilized in a plurality of toilet infectious airborne particulate filtration and disinfection system designs. In embodiments not shown, the lid assembly 114 can include one, two, three, four or more feet 122 or bumpers 122.

Figure 3:
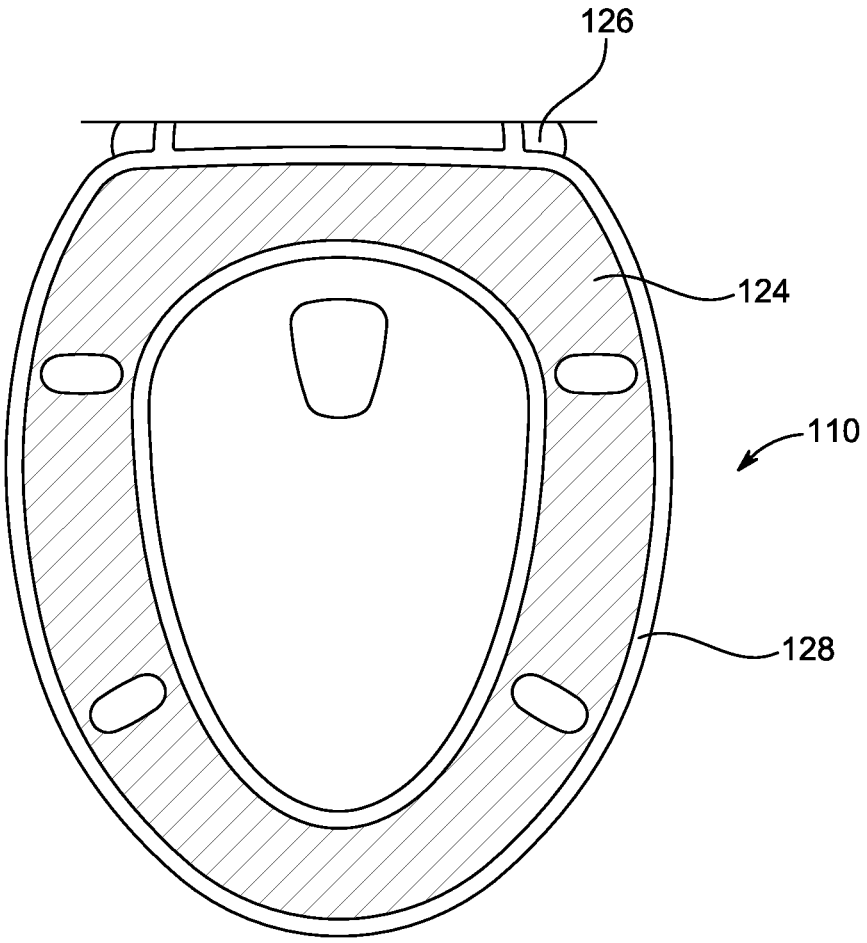
FIG. 3 presents a top view of a modified toilet seat assembly showing lid filtration interface in an embodiment of the system.

As best seen in FIG. 3, the lid air filtration unit 124 interfaces onto a top surface 128 of the seat assembly 110 when the lid 114 is in a down position.

Figure 4:
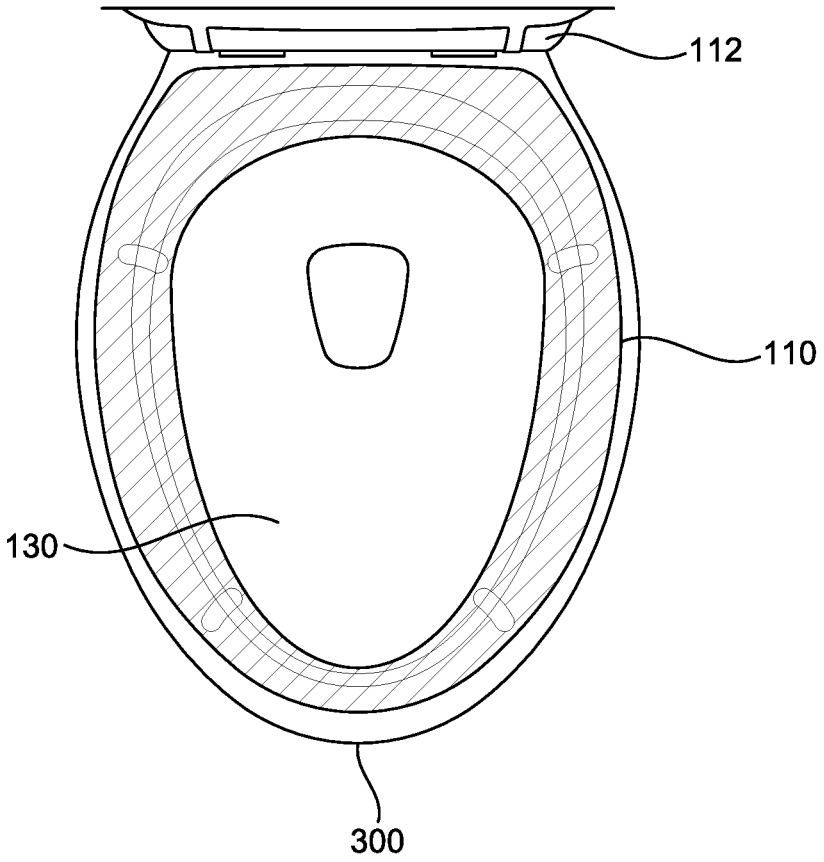
FIG. 4 presents a top view of a toilet bowl rim showing seat filtration interface in an embodiment of the present invention.

Referencing FIG. 4, The seat air filtration unit 110 interfaces onto a top surface of a toilet bowl rim 300 when the seat assembly 100 is in a down position.

Figure 5A:
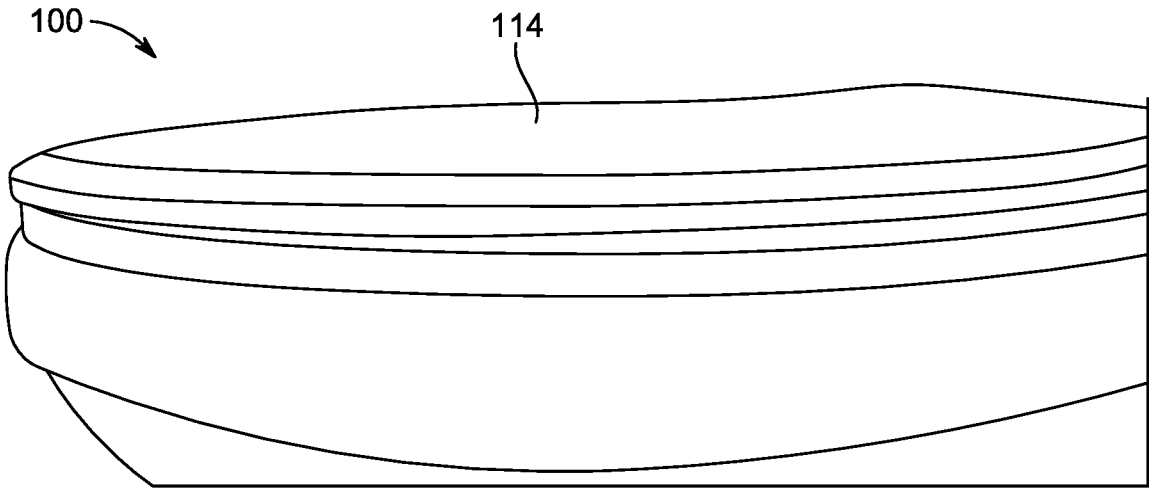
FIGS. 5A and 5B presents side views of the modified seat and lid in a down position in an embodiment of the system.
Figure 5B:
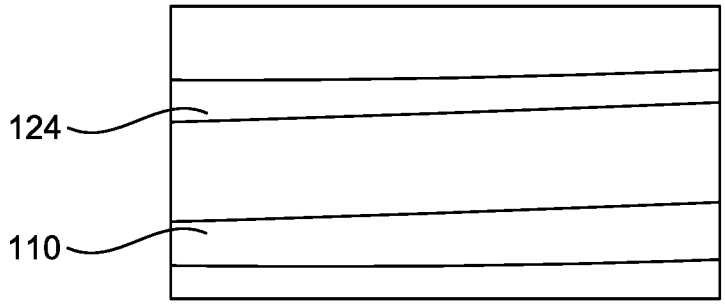

FIGS. 5A and 5B illustrates side views of composite components of the lid assembly 114 and the seat assembly 100 when they are both in the down position. As best seen in FIGS. 5A and 5B, the lid filter unit 124 fits between the lid assembly 114 and the seat assembly 100 and the seat filter unit 110 fits between the seat assembly 100 and the toilet bowl rim 300 when the components are in the down position.

Figure 6:
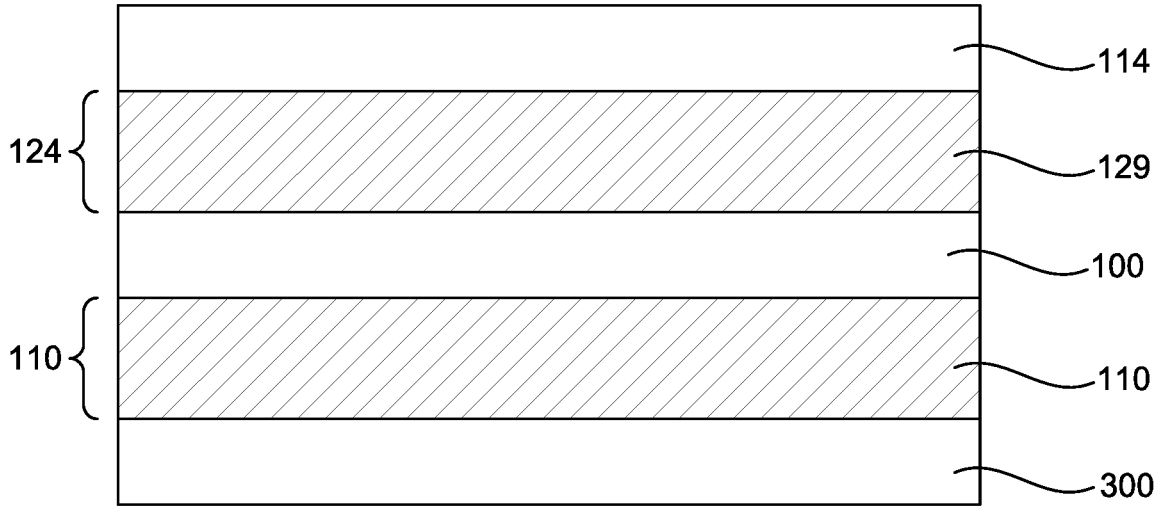
FIG. 6 presents a side view of the filtration system displaying the stacked arrangement in an embodiment of the present invention.

FIG. 6 shows the composite air filtration arrangement of the lid filter 124 and the seat filter 110 providing filtration of all air expelled from the interior of the toilet. Also displayed is the plurality of heights of both the lid filter 124 and the seat filter 110 allowing for a greater or lesser cross-sectional area of air flow through the filter media. The variable heights can be predetermined based on the toilet design and expected maximum air flow rates and total air flow volumes.

Figure 7:
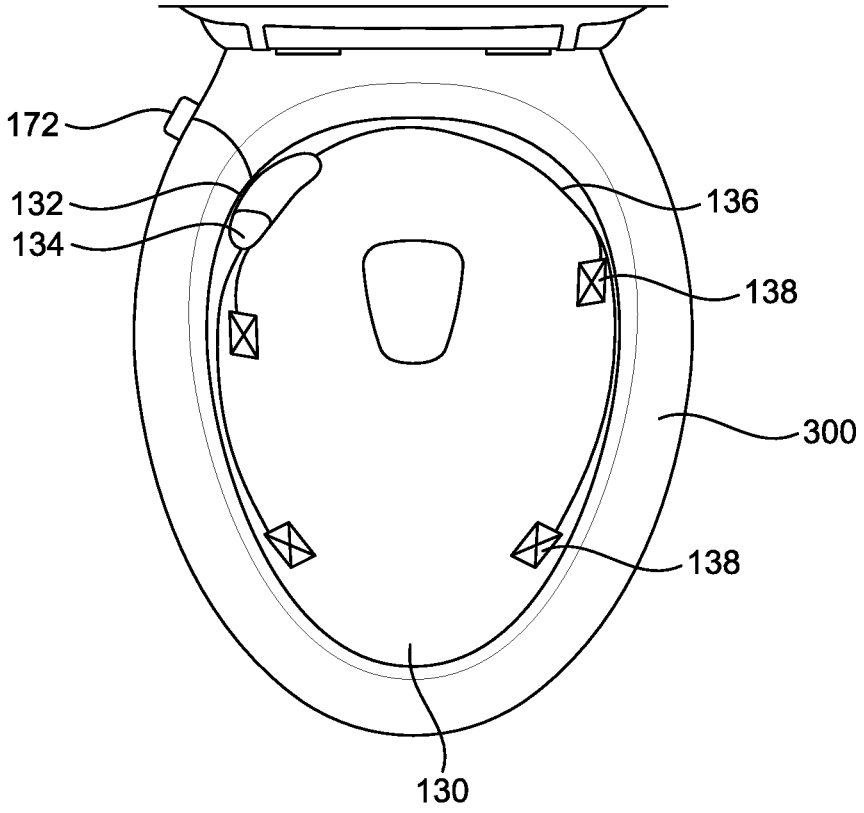
FIG. 7 presents a top view of the disinfectant fluid dispersing mechanism in an embodiment of the system.

FIG. 7 displays a top view of the toilet and shows disinfectant fluid reservoir 132, fluid control mechanism 134, fluid delivery tubes 136, and spray nozzles 138 are connected and positionable within the interior of the toilet and designed to provide disinfectant spray manually and/or automatically. The internally arranged disinfectant dispersing mechanism is configured to provide disinfectant fluid mist to come to rest on toilet interior surfaces 130 to continuously provide disinfectant to potentially infectious matter. Further, deployment of the disinfectant automatically and manually provides for enhanced sanitary conditions for personnel performing air filter 110 and 124 changes. Also, the system can include an exterior reservoir 170 configured to hold disinfectant fluid for use in providing disinfectant spray manually and/or automatically. The spray can be initiated automatically when the toilet is flushed and/or manually with the system activation control device 170.

Figure 8A:
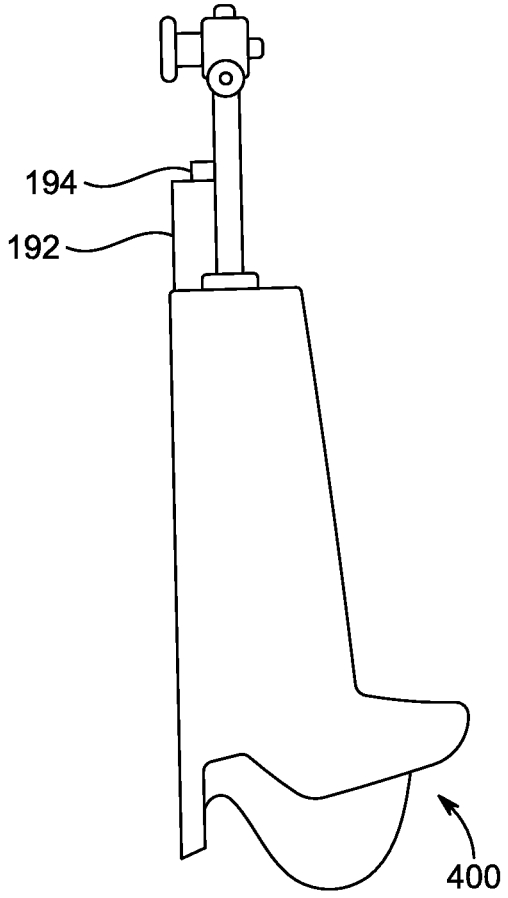
FIGS. 8A and 8B presents side views of urinal filtration systems in an embodiment of the present invention.
Figure 8B:
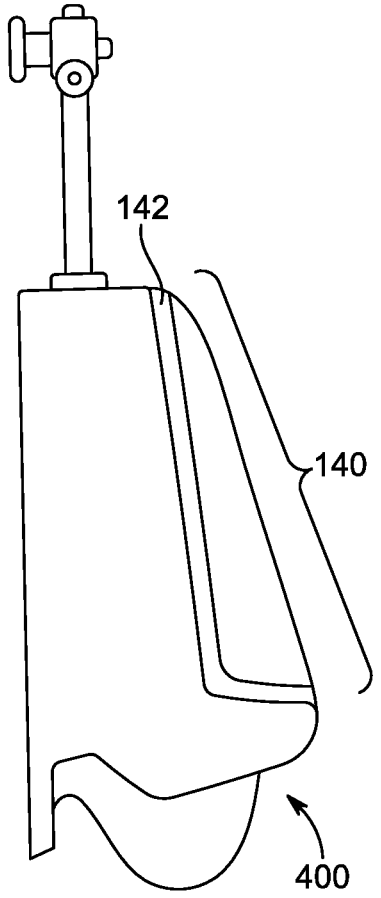

FIGS. 8A and 8B illustrates side views of a standard urinal 400 with a urinal lid assembly 140 and a urinal filter interface 142 and contrasted to a standard urinal 400 without an assembly 140 or an interface 142. As best seen in FIGS. 8A and 8B, the urinal filter interface 142 makes contact with the urinal 400 on one side of the interface 142 and the urinal lid assembly 140 on another side of the interface 142. The system can include a disinfectant reservoir 192 positionable on a top and exterior of the standard urinal 400. The reservoir 192 can be configured to allow refilling of the reservoir 192 and arranged to provide for gravity feeding of disinfectant to spray nozzles 198 and with disinfectant activation mechanism 194 allow for automatic and/or manual activation of the disinfectant with prime mover assist. The disinfectant delivery can also be configured to be activated upon activation of the standard urinal 400 flush sequence.

Figure 9A:
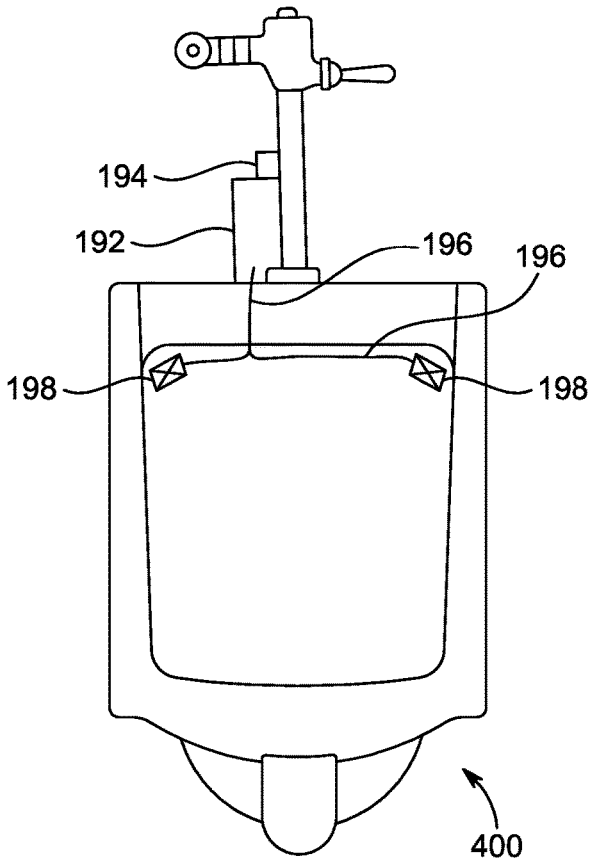
FIGS. 9A and 9B presents front views of urinal filtration systems in an embodiment of the present invention.
Figure 9B:
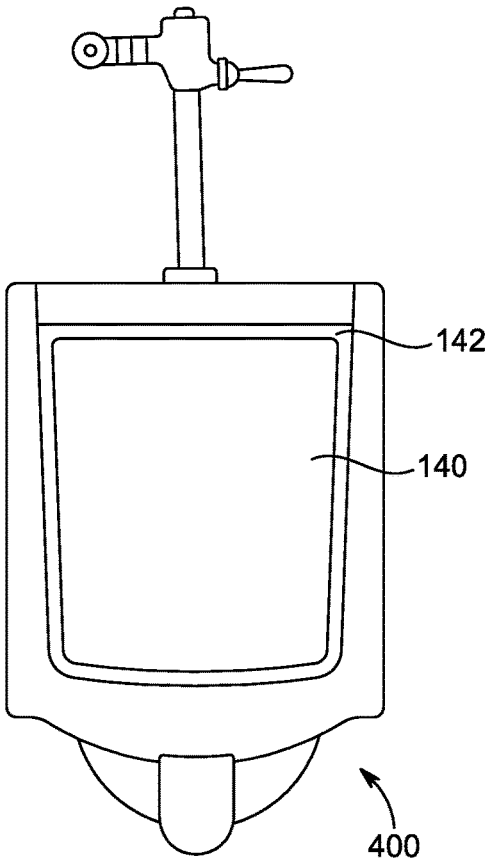

FIGS. 9A and 9B illustrates front views of a standard urinal 400 with a urinal lid assembly 140 and a urinal filter interface 142 and contrasted to a standard urinal 400 without an assembly 140 or an interface 142. As best seen in FIGS. 9A and 9B, the urinal filter interface 142 makes contact with the urinal 400 on one side of the interface 142 and the urinal lid assembly 140 on another side of the interface 142. The urinal filter interface is configured to include a plurality of heights and thicknesses and can allow for a greater or lesser cross-sectional area of air flow through the filter media of the urinal filter interface 142. The variable heights can be predetermined based on the toilet design and expected maximum air flow rates and total air flow volumes. As seen in FIG. 9A, the disinfectant reservoir 192 can be configured to be positionable on top and exterior to the standard urinal 400. Further, the disinfectant can be activated manually and/or automatically with the disinfectant system activation mechanism 194 and allow gravity and/or a prime mover within the disinfectant system activation mechanism 194 to propel disinfectant to interior spaces of the standard urinal 400. Also as seen in FIG. 9A, disinfectant can be dispersed within interior spaces of the standard urinal 400 with fluid delivery tubes 196 carrying disinfectant fluid to spray nozzles 198, wherein the spray nozzles 198 are positionable within interior spaces of the standard urinal 400 and arranged to provide disinfectant fluid to cover the interior surfaces of the standard urinal 400 upon activation.

Figure 10A:
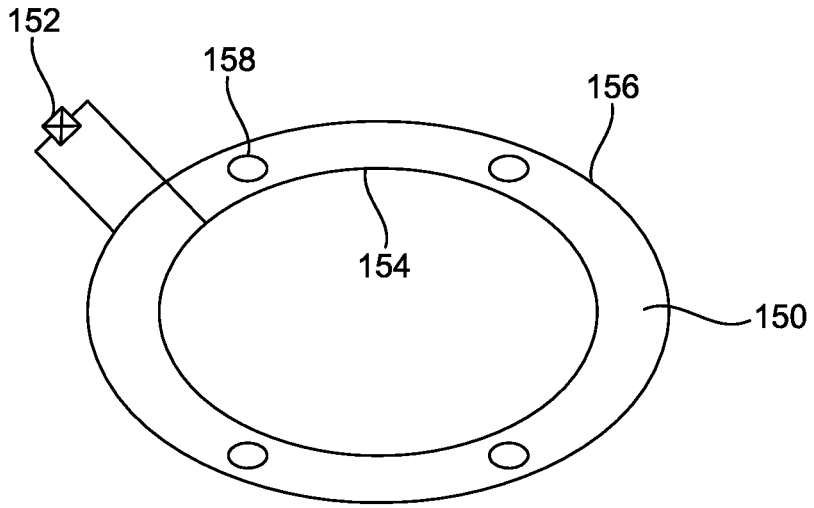
FIGS. 10A and 10B presents top and side views of a system filter in an embodiment of the present invention.
Figure 10B:
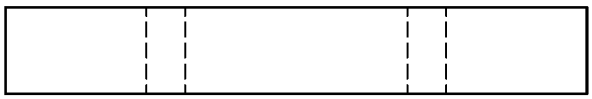

FIGS. 10A and 10B displays a top view and a side view of air filter media cartridges 150 which are configurable and designed to provide for like for like replacements for lid filters 124, seat filters 110, and urinal filter interfaces when the filters are replaced. Replacement of the filters can occur on a preset time frame, based on a differential pressure measurement across the filter between and filter inlet side 154 and the filter exit side 156. The filter can also be replaced upon the depleted air freshener that is preloaded into the filter media cartridges 150 is detected. In embodiments as shown, the filter media cartridges can include additional filter cutouts 158 and other embodiments without any cutouts.

Also as seen in FIG. 10B the filter media cartridges 150 can include a plurality of heights. The heights can be configured to provide appropriate air filtration for predetermined values based on the toilet design and/or urinal design and expected maximum air flow rates and total air flow volumes.

While the written description of the exemplary embodiments enables one of ordinary skill to make and use what is considered presently to be the best mode thereof, those of ordinary skill will understand and appreciate the existence of variations, combinations, and equivalents of the specific embodiment, method, and examples herein. The exemplary embodiments should therefore not be limited by the above-described embodiment, method and examples, but all embodiments and methods within the scope and spirit of the exemplary embodiments as claimed.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

Insofar as the description above and the accompanying drawings disclose any additional subject matter that is not within the scope of the claims below, the inventions are not dedicated to the public and the right to file one or more applications to claim such additional inventions is reserved.

What is claimed is:

1. A toilet infectious airborne particulate filtration and disinfection system comprising:

a modified toilet seat assembly, wherein the modified toilet seat assembly further comprises;

rear attachment devices configured to attach the modified toilet seat assembly to a standard toilet bowl;

circumferentially arranged grooves on an underside of the modified toilet seat assembly;

a seat air filtration unit configured to mate with the circumferentially arranged grooves on the underside of the modified toilet seat assembly and arranged to form an airtight seal between a top surface of a toilet bowl rim and the underside of the modified toilet seat assembly when the modified seat assembly is positioned in a down position, and the modified seat assembly and the seat air filtration unit is resting upon the top surface of the toilet bowl rim;

a modified toilet lid assembly, wherein the modified toilet lid assembly further comprises;

rear attachment devices configured to attach the modified toilet lid assembly to the modified toilet seat assembly;

circumferentially arranged grooves on an underside of the modified toilet lid assembly;

a lid air filtration unit configured to mate with the circumferentially arranged grooves on the underside of the modified toilet lid assembly and arranged to form an air tight seal between a top surface of the modified toilet seat assembly and the underside of the modified toilet lid assembly when the modified lid assembly is positioned in a down position, and the modified lid assembly and the lid air filtration unit is resting upon the top surface of the modified toilet seat assembly;

an internally arranged disinfectant dispersing mechanism, wherein the disinfectant dispersing mechanism further comprises;

a disinfectant fluid reservoir, positioned internally to a toilet bowl enclosure;

a plurality of spray nozzles positionable about the toilet bowl enclosure;

a plurality of disinfectant fluid delivery tubes positioned internally to the toilet bowl enclosure connecting the disinfectant fluid reservoir to the plurality of spray nozzles; and a disinfectant propellant mechanism configured to provide a moving force to disperse disinfectant fluid through the plurality of spray nozzles.

2. The system as recited in claim 1 wherein the seat air filtration unit includes adhesive components, wherein the adhesive components are designed to maintain the seat air filtration unit in place during normal operation.

3. The system as recited in claim 1 wherein the lid air filtration unit includes adhesive components, wherein the adhesive components are designed to maintain the lid air filtration unit in place during normal operation.

4. The system as recited in claim 1 wherein the seat air filtration unit includes HEPA filter components, wherein the HEPA filter components are designed to provide enhanced filtration during normal operation.

5. The system as recited in claim 1 wherein the lid air filtration unit includes HEPA filter components, wherein the HEPA filter components are designed to provide enhanced filtration during normal operation.

6. The system as recited in claim 1 wherein a vertical distance between the top surface of the toilet bowl rim and the underside of the modified toilet seat assembly, when the modified toilet seat assembly is in the down position, wherein the seat air filtration unit is capable of being provided in a plurality of heights, wherein the plurality of heights of the seat air filtration unit is designed to accommodate a plurality of design air flows and/or a plurality of design air filtrations and/or a plurality of clean air delivery rates.

7. The system as recited in claim 1 wherein a vertical distance between the bottom surface of the modified toilet bowl lid and the top side of the modified toilet seat assembly, when the modified toilet bowl lid is in the down position, wherein the seat air filtration unit is capable of being provided in a plurality of heights, wherein the plurality of heights of the lid air filtration unit is designed to accommodate a plurality of design air flows and/or a plurality of design air filtrations and/or a plurality of clean air delivery rates.

8. The system as recited in claim 1 wherein the seat air filtration unit and/or the lid air filtration unit are replaceable and are configured to be manually changed out when the seat air filtration unit and/or the lid air filtration unit are depleted.

9. The system as recited in claim 1 further including a differential pressure sensor configured to detect when the seat air filtration unit and/or the lid air filtration unit are depleted.

10. The system as recited in claim 1 further including seat air filtration unit and/or the lid air filtration unit which are infused with air freshener and configured to disperse air freshener when air flow occurs across the seat air filtration unit and/or the lid air filtration unit.

* * * * *